US006223493B1

(12) United States Patent
Ruggeri

(10) Patent No.: US 6,223,493 B1
(45) Date of Patent: May 1, 2001

(54) SELF-ALIGNING BUILDING BLOCKS

(76) Inventor: John Robert Ruggeri, 604 Stafford La., St. Augustine, FL (US) 32086

( * ) Notice: Subject to any disclaimer, the term of this patent is extended or adjusted under 35 U.S.C. 154(b) by 0 days.

(21) Appl. No.: 09/452,600

(22) Filed: Dec. 1, 1999

(51) Int. Cl.[7] ..... E04B 2/08

(52) U.S. Cl. ..... 52/592.6; 52/603; 52/604; 52/606

(58) Field of Search ..... 52/603, 604, 606, 52/561, 592.6

(56) References Cited

U.S. PATENT DOCUMENTS

| | | | | |
|---|---|---|---|---|
| 800,067 | | 9/1905 | Brooke . | |
| 2,019,653 | | 11/1935 | Buyer . | |
| 2,205,419 | * | 6/1940 | Kraemer | 52/606 |
| 3,534,518 | | 10/1970 | Zagray . | |
| 4,186,540 | | 2/1980 | Mullins . | |
| 4,787,189 | | 11/1988 | Haug et al. . | |
| 4,802,318 | * | 2/1989 | Snitovski | 52/309.12 |
| 5,457,926 | * | 10/1995 | Jensen | 52/604 |
| 5,623,797 | | 4/1997 | Gravier et al. . | |
| 5,894,702 | | 4/1999 | Stenekes . | |
| 5,899,040 | * | 5/1999 | Cerrato | 52/604 |
| 5,901,520 | | 5/1999 | Abdul-Baki . | |
| 6,122,881 | * | 9/2000 | Aubertot | 62/604 |

FOREIGN PATENT DOCUMENTS

| | | | | |
|---|---|---|---|---|
| 1525199 | * | 4/1967 | (FR) | 52/603 |
| 2 149 828 | * | 11/1983 | (GB) | 52/561 |

* cited by examiner

*Primary Examiner*—Carl D. Friedman
*Assistant Examiner*—Kevin McDermott
(74) *Attorney, Agent, or Firm*—Thomas C. Saitta

(57) ABSTRACT

The invention is a self-aligning cementitious block and a wall system of such blocks stacked and joined by mortar to form a vertically oriented wall structure, where the block comprises alignment features which correctly align the block relative to the blocks upon which it is stacked such that the side walls are parallel to the side walls of the lower blocks. The alignment features comprise projection members and recess members of corresponding configuration, where the projection members preferably extend downward from the two end walls and the middle wall a distance below the lower longitudinal edges of the side walls, and where the recess members are positioned on the tops of the end walls and middle wall, the recess members of inferior or lower blocks receiving the projection members of a superior or upper block stacked thereupon. Starter blocks with a flat underside and corner blocks are also provided.

16 Claims, 3 Drawing Sheets

SELF-ALIGNING BUILDING BLOCKS

BACKGROUND OF THE INVENTION

This invention relates generally to the field of building blocks, usually formed of cementitious material, which are used as stacked components in the construction of walls and structures. More particularly, the invention relates to such articles which are shaped such that the blocks interlock or align when stacked.

Cementitious building blocks, often known as cement or concrete blocks, are well known in the masonry and construction fields. In the most common configuration, the blocks are rectangular with dimensions of approximately 8 inches in height and depth and 16 inches in length. The blocks are not solid but are provided with two vertically oriented openings separated by a lateral internal wall or web member, such that the blocks possess a shape similar to the number "8" with rectangular corners when viewed from the top or bottom. The open interiors reduce the weight of the block, allow less material to be consumed in their formation, and provide vertical channels in the finished wall structure for the passage of wiring, plumbing or conduits, or for receipt of filler materials such as poured concrete to increase strength, insulation or other properties. Such blocks have been in use for many years, and when properly joined by mortar interspersed between adjacent blocks they form extremely solid structures. Constructing a wall from discrete blocks requires a certain degree of skill, since wet mortar must be applied to the proper surfaces of the previously laid blocks and/or to the proper surfaces of the block to be laid, then the block must be positioned and aligned with the previously laid blocks such that the height of each row remains constant and such that the wall possesses a planar inner and outer surface.

Because the proper laying of block is a time-consuming, labor-intensive and skilled task, alternative block structures, configurations and systems have been developed which address one or more of these problems. One approach has been to provide mortarless blocks, i.e., blocks which interlock in a secure manner without the need for the addition of mortar or other bonding material between individual blocks. The blocks are usually constructed such that each possesses both male and female mating components, such as a pair of longitudinal channels on the top and a pair of longitudinal ridges on the bottom, so that the channels of the lower block receive the ridges of the block set above it. Other projection/recess or tongue/groove mating configurations are also known and utilized. Many systems use the interlocking blocks merely as forms to receive poured concrete, with the blocks often formed of polystyrene foam. Examples of such systems are seen in U.S. Pat. No. 5,901,520 to Abdul-Baki, U.S. Pat. No. 5,894,702 to Stenekes, U.S. Pat. No. 5,623,797 to Gravier et al., U.S. Pat. No. 5,457,926 to Jensen, U.S. Pat. No. 4,186,540 to Mullins, and U.S. Pat. No. 3,534,518 to Zagray. Mortarless systems have met with rather limited success, however, since conventional block-making equipment cannot produce blocks with less than a 1/16 inch variation in height between individual blocks. Even such a small variation is enough to cause unacceptable deviation from plumb after only 3 or 4 courses. The use of mortar between blocks compensates for this variation, since the height of the mortar can be varied to properly position each block at the proper height. Mortar also serves to seal joints and provides a measure of flexural strength, so eliminating mortar is not necessarily beneficial.

Other systems of interlocking or aligning blocks have been developed where mortar or grout is still used in some degree to join adjacent blocks in a more secure manner beyond that provided by the interlocking or aligning structures alone. For example, Brooke in U.S. Pat. No. 800,067 discloses blocks having longitudinal tongue and groove alignment means along the edges, where mention is made that cement or grout is utilized to construct the wall. Buyer in U.S. Pat. No. 2,019,653 shows blocks having centralized raised bosses and corresponding sockets for alignment, where the bosses sockets have a flat surface bounded by two sloping lateral surfaces, where the flat and sloping surfaces abut directly when the blocks are stacked. A recess is provided along the horizontal joint between courses for receiving mortar or grout after the blocks have been stacked. Finally, Huag et al. in U.S. Pat. No. 4,787,189 shows another type of interlocking blocks where the center of the blocks have longitudinal tongue and groove configurations. A problem with the Brooke and Huag et al. systems is that both still require skilled application of the mortar in the right amount to the proper locations, since there is no provision in the designs to allow for excess or misplaced mortar. Any mortar which inadvertently falls into the tongue and groove areas will interfere with and prevent proper alignment of the blocks, necessitating the lifting of the block and removal of the excess material. The Buyer system is in effect a mortarless system, with all the inherent problems of those types, since the mortar or grout is not applied until after the blocks have been stacked. Should the mortar be applied prior to stacking, the Buyer design likewise provides no margin for application error, since the sloped surfaces make direct contact when the blocks are stacked and excessive or misplaced mortar will interfere with the proper fit and alignment.

It is an object of this invention to provide a cementitious building block and system where the blocks are self-aligning and interlock to provide a wall structure having generally planar inner and outer wall surfaces, where the courses are easily maintained at plumb as the height of the wall increases. It is a further object to provide such a block and system where the blocks can be properly stacked in a fast and non-complicated manner, such that the task can be performed by relatively unskilled labor having only the most basic of mortar application skills. It is a further object to provide such a system where mortar is utilized to join adjacent blocks, such that the joints are sealed, flexural strength is enhanced, and variations in block height can be compensated for. These and other objects not expressly stated will be apparent based on the disclosure and description of the invention, its best mode and preferred embodiment, as set forth below.

SUMMARY OF THE INVENTION

The invention is a self-aligning cementitious block and a system of such blocks stacked and joined by mortar to form a vertically oriented wall structure, where the block comprises alignment means which correctly align the block relative to the blocks upon which it is stacked such that the side walls are parallel to the side walls of the lower blocks. The alignment means comprise projection members and recess members of corresponding configuration, where the projection members preferably extend downward from the two end walls and the middle wall a distance below the lower longitudinal edges of the side walls, and where the recess members are positioned on the tops of the end walls and middle wall, the recess members of inferior or lower blocks receiving the projection members of a superior or upper block stacked thereupon.

The projection members comprise a central tongue member having a planar lower edge bounded by a pair of short, upstanding side walls, and a pair of sloping walls connecting the side walls to the lower longitudinal edges of the block. The recess members comprise a central groove member having a planar lower edge bounded by a pair of short, upstanding side walls, and a pair of sloping walls connecting the side walls to a point on the interior side walls below the upper longitudinal edges of the block. The groove side walls are shorter than the tongue side walls, such that the overall height of the projection members is greater than the overall depth of the groove members, such that when a block is placed atop another block or set of blocks with the tongue lower edge resting on the groove lower edge, the tongue sloping walls and groove sloping walls will not abut, thereby creating a pair of interior wall recesses. Likewise, the lower longitudinal edges of the upper block does not abut the upper longitudinal edges of the lower block or blocks, thereby creating a longitudinal joint recess which contains mortar. The alignment means insure that the blocks are properly oriented and the mortar bonds the blocks together.

Corner blocks are provided in the system, the corner blocks being identical to the standard block in regard to the projection members on the end walls and the middle wall, and to the recess members on one end wall and the middle wall. The opposing end wall is an exterior end wall and has a planar upper lateral edge rather than a recess member. A pair of recess members of identical configuration are positioned in the side walls of the block between the middle wall and the end wall with the planar upper lateral edge. To form a corner, each superior corner block is positioned perpendicular to the inferior corner block, such that the projection members extending beneath the middle and exterior end walls of the superior block sit in the recess members positioned in the side walls of the inferior block. In this manner the exterior end walls present a solid square surface to the outside of the corner in conjunction with the solid side walls of the standard blocks. Starter blocks having a planar lower surface with no projecting members are provided to form the first or base course of blocks.

In assembling the block wall structure, the worker applies mortar to either the upper longitudinal edge of an inferior block or row of blocks or the lower longitudinal edge of the block to be joined, as well as to the end wall of the adjacent block or the block to be joined. The worker sets the projection members into the recess members, such that the block is correctly aligned relative to the inferior blocks and adjacent block. Any excess mortar placed into the longitudinal joint recess is extruded by the weight of the block outward, where it is easily removed, or inward into the interior wall recesses between the sloping walls of the projection members and recess members. Any mortar extruded inward does not therefore interfere with the proper vertical setting of the block.

DETAILED DESCRIPTION OF THE INVENTION

With reference to the drawings, the invention will now be described in detail with regard for the best mode and the preferred embodiment. In general, the invention comprises blocks which are configured to self-align when stacked into a wall configuration so that each successive course or row of blocks is properly aligned with the lower course or row of blocks to provide generally planar front and back wall surfaces. The blocks are also configured so that the blocks in the uppermost course are automatically situated at the proper height relative to the lower course. The blocks are provided with alignment means comprising projection members and recess members such that alignment occurs in a tongue-and-groove manner. As discussed herein, the projection members are shown to be on the bottom of the block and the recess members are shown to be on the top of the block, but it is to be understood that this is purely a matter of engineering choice and the blocks can also be configured with the projection members disposed on the top and the recess members on the bottom of the blocks. Specially configured corner blocks and starter blocks are provided to complete the system whereby right angle corner walls can be constructed. The blocks are joined by mortar or other bonding material to form the finished structure. It is preferred that the blocks be formed of a cementitious material, such as cement or concrete, but any material known in the industry which is structurally suitable for construction of building blocks to support a load or form a lateral barrier may be utilized. In addition, while the dimensions of the blocks discussed herein are generally equal to those of the standard building blocks most commonly used in the industry, it is to be understood that the dimensions may be varied in that it is the overall configuration of the block which is of most importance.

Figure 1:
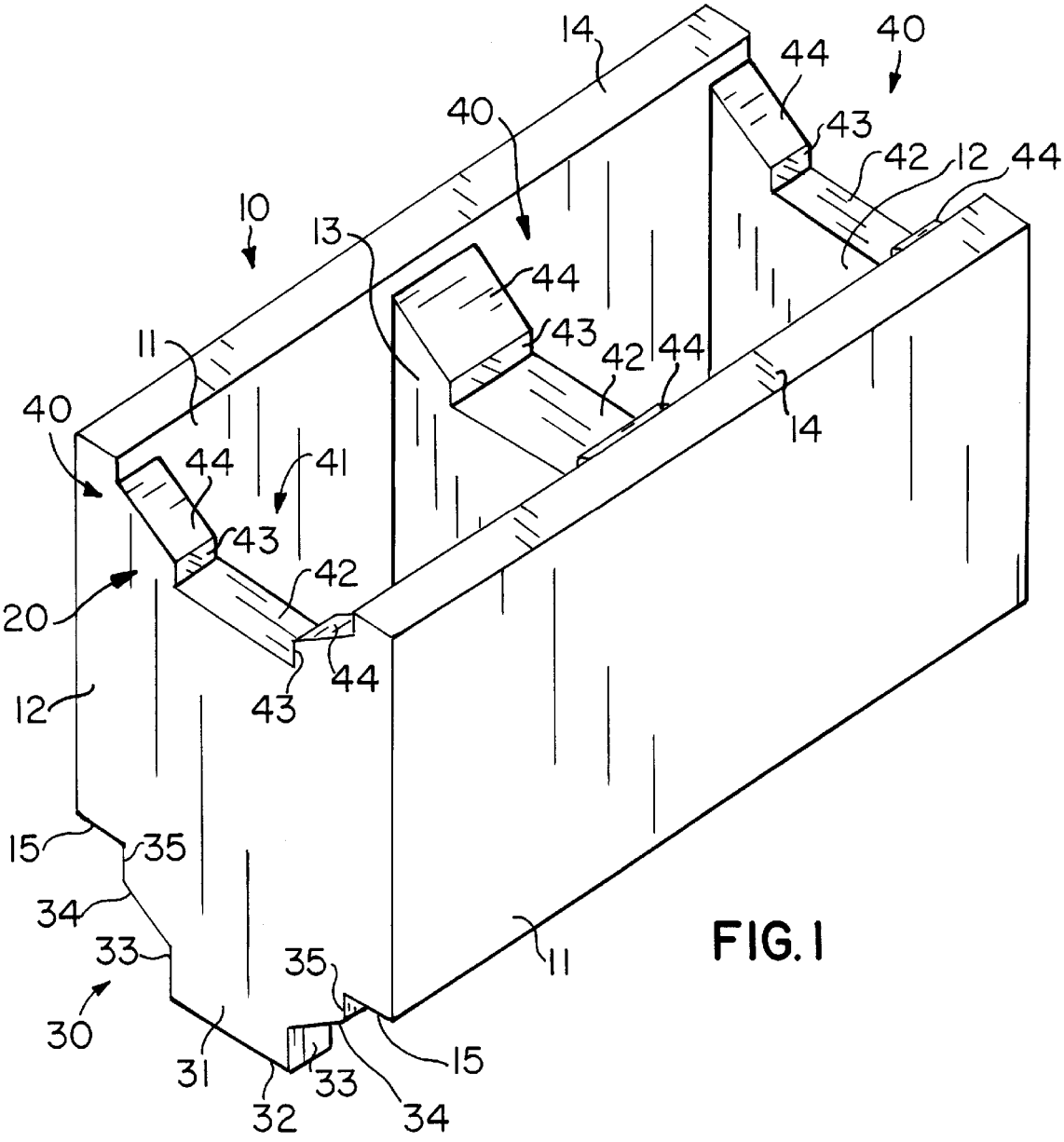
FIG. 1 is a perspective view of the standard block of the invention.
Figure 3:
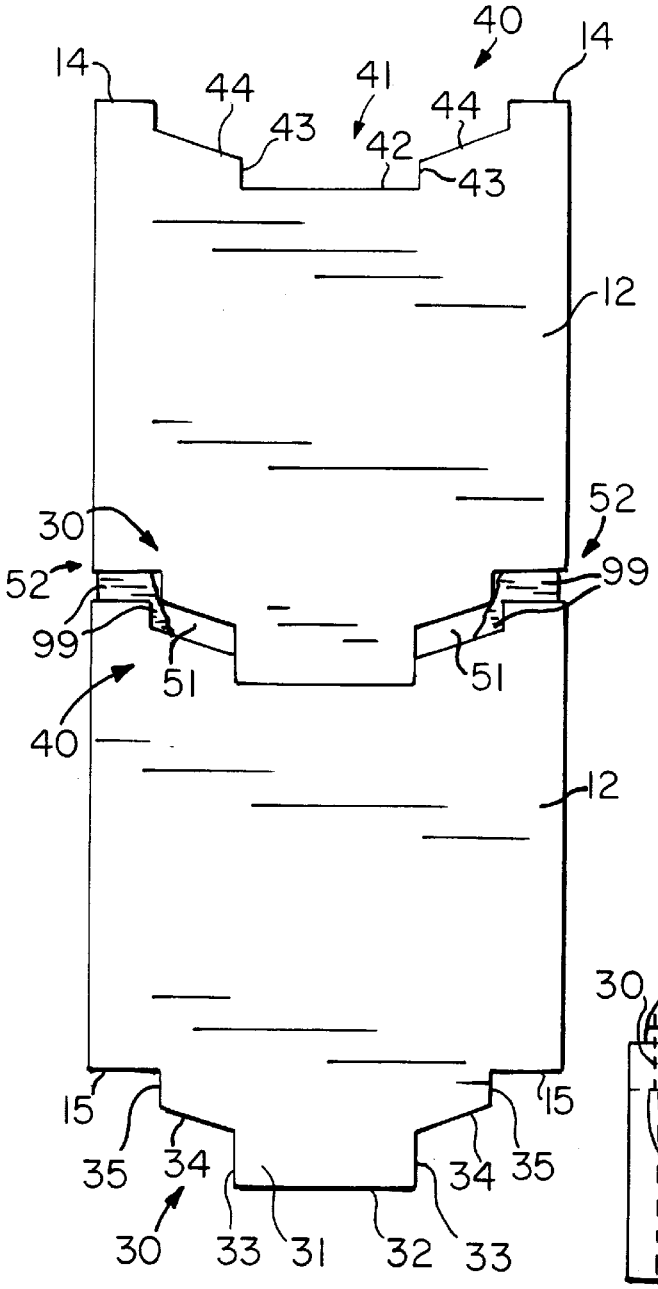
FIG. 3 is an end view showing a superior block seated on an inferior block.
Figure 2:
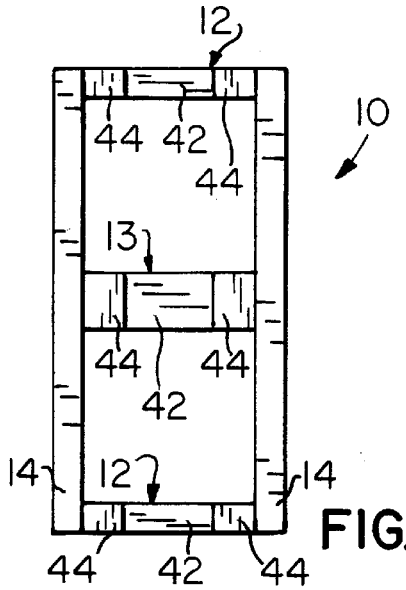
FIG. 2 is a top view of the standard block.

The main block configuration is shown in FIGS. 1, 2 and 3, where the block 10 is seen to comprise a pair of opposing, parallel side walls 11, a pair of opposing, parallel end walls 12 joined at right angles to the side walls, and preferably a middle wall 13 extending perpendicularly between and joining the side walls 11 and centered at the midpoint between the end walls 12. The side walls 11 are rectangular in overall shape with a smooth or textured external surface, with each having an upper longitudinal edge 14 and a lower longitudinal edge 15 extending from end wall 12 to opposing end wall 12, with the upper and lower longitudinal edges 14 and 15 preferably presenting flat surfaces for receipt of mortar 99. Suitable dimensions for the side walls 11 are about eight inches in height and about sixteen inches in length, with the outer distance between opposing side walls 11 being about eight inches, such that the dimensions of the exposed side walls 11, the thickness of the block 10 and the height of the block 10 are generally equal to the dimensions of commonly known building blocks. A wall thickness of about one inch for the side walls 11 and end walls 12 is suitable, with the middle wall 13 preferably having a larger thickness dimension of about two inches.

The block 10 is provided with alignment means 20 which acts to automatically align the block 10 in proper relation to the blocks 10 in the course below it. The alignment means 20 aligns the block both laterally, such that the side walls 11 are parallel to the side walls of lower blocks 10, and vertically, such that the upper longitudinal edges 14 of the upper block 10 are the correct distance above and parallel to the upper longitudinal edges 14 of the lower blocks 10 upon which the block 10 is set. The alignment means 20 comprises mating elements which physically abut each other, such that the vertical load placed on or inherent to the wall is supported by the vertical stacks of blocks 10. The alignment means 20 on a block 10 comprises projection members 30 which extend beneath or form the lower portion of the end walls 12 and middle wall 13, and corresponding recess members 40 which occupy or form the upper portion of the end walls 12 and middle wall 13. The projection members 30 and recess members 40 are disposed laterally between the lower longitudinal edges 15 and upper longitudinal edges 14, respectively. The projection members 30 extend below the side walls 11.

The projection members 30 each comprise a tongue member 31 having a generally planar tongue lower edge 32 and a pair of opposing, vertical tongue side walls 33. The tongue member 31 is defined by a pair of sloping walls 34 which extend downward and inward from the bottom of a pair of opposing, vertical, joint recess side walls 35 which meet the lower longitudinal edges 15 of the side walls 11, where the sloping walls 34 meet the tops of the tongue side walls 33. Suitable dimensions are a height of about one half inch for the joint recess side walls 35, a length of about one and a third inches for the sloping walls 34, a height of about one inch for the tongue side walls 33 and a lateral width of about three inches for the tongue lower edge 32. This produces an inward slope of about eighteen degrees for the sloping walls 33. The overall height of the projection member 30 is about two inches beyond the lower longitudinal edges 15.

The recess members 40 each comprise a groove member 41 having a generally planar groove lower edge 42 and a pair of opposing, vertical groove side walls 43. The groove member 41 is defined by a pair of sloping walls 44 which extend downward and inward from the interior of the side walls 11, with the junctions of the sloping walls 44 and side walls 11 being disposed a distance below the upper longitudinal edges 14. The sloping walls 44 meet the tops of the groove side walls 43. Suitable dimensions corresponding to the dimension for the projection members 30 are for the sloping walls 34 to be disposed about one half inch below the upper longitudinal edges 14 with a length of about one and a third inches, the groove side walls 43 to be about one half inch in height, and the groove lower edges 42 to be about three inches in lateral width. This provides for an inward slope of about eighteen degrees for the sloping walls 44 and an overall depth of the recess member 40 of about one and one half inches beneath the upper longitudinal edges 14. The lateral width of the tongue members 31 and groove members 41 are chosen such the tongue members 31 fit snugly into the groove members 41 such that relative lateral movement is precluded.

The tongue side walls 33 are longer than the groove side walls 43, as it is necessary that the tongue member 31 be longer than the groove member 41. Because of this configuration, when a block 10 is placed onto a lower course of blocks 10, as shown in FIG. 3, only the lower edges 32 and the side walls 33 of the tongue members 31 of the upper block 10 will contact the lower edges 42 and the side walls 43 of the groove members 41 of the lower blocks 10. The excess length of the tongue members 33 maintains the tongue sloping walls 34 a short distance above and separated from the groove sloping walls 44 of the blocks 10 below, thereby creating interior wall recesses 51 between the blocks 10. Likewise, the excess length of the tongue members 33 maintains the lower longitudinal edges 15 of the upper block 10 a short distance above the upper longitudinal edges 14 of the lower blocks 10, thereby defining a longitudinal joint recess 52 to receive the mortar 99. These features are important to account for excess or improperly applied mortar 99. To bond a block 10 to the lower course of blocks 10, mortar 99 is applied along the upper longitudinal edges 14 of the lower blocks 10, as well as to the end wall 12 of the block 10 being laid which will abut the adjacent block 10 already positioned in the same course. When the block 10 is set onto the lower course of blocks 10 by placing the tongue members 31 into the groove members 41, the block 10 is seated at the proper height and aligned properly in the lateral direction. Any excess mortar 99 will be pressed outward from the longitudinal joint recesses 52 to be removed by hand or inward into the interior wall recesses 51 formed between the sloping walls 34 and 44. The interior wall recesses 51 prevent the excess mortar 99 from interfering with the proper fit between the block 10 and the lower course of blocks 10, both vertically and horizontally, since the excess mortar 99 falls harmlessly into the interior wall recesses 51.

Figure 4:
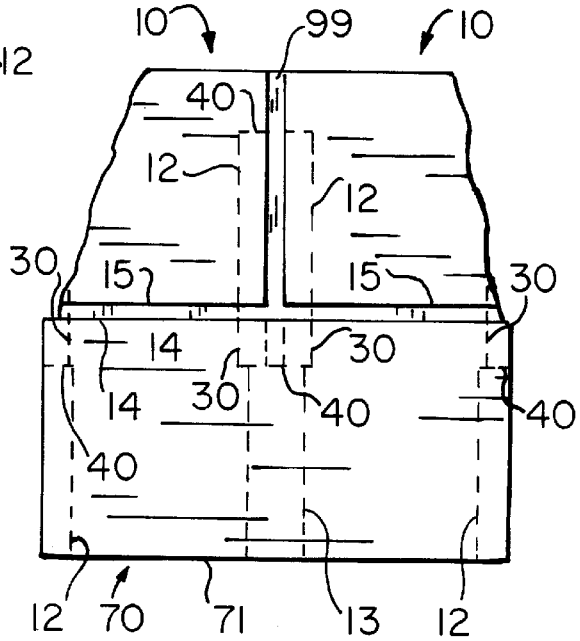
FIG. 4 is a side view showing a course of standard blocks seated on a starter block, with the projection members and recess members shown in outline taken along a central portion of the blocks.

In the normal style of wall construction, the blocks 10 are set such that the vertical joints between blocks in a course are centered over the middle walls 13 of the blocks 10 in the lower course, as shown in FIG. 4, which illustrates the need for the middle walls 13 to be thicker in the longitudinal direction than the end walls 12, since two end walls 12 of adjacent blocks 10 separated by mortar 99 will rest on the middle wall 13 of the lower block 10.

Most preferably, the joint recess side walls 35 of the projection member 30 are disposed inward of the interior edge of the lower longitudinal edges 15, such that the groove sloping walls 44 are slightly longer than the tongue sloping walls 34 and such that the lower longitudinal edges 15 extend farther toward the interior of the block 10 at the end walls 12 and middle wall 13. For example, with the dimensions as given above, the groove sloping walls 44 are about one and one half inches in length, with the tongue sloping walls remaining about one and one third inches. This prevents the lower edges of the joint recess side walls 35 from contacting the interior edges of the upper longitudinal edges 14, thereby allowing for some dimensional variability in the production of the blocks 10 which could cause misalignment of stacked blocks 10.

Unless the lowermost course of blocks 10 is set into wet concrete or cement, the system requires the use of starter blocks 70, as shown in FIG. 4, which have a flat lower lateral edge 71 with no projection members 30 extending beneath the block 10. The first course of a wall would consist of starter blocks 70 placed onto a flat support slab or floor. The remainder of the courses would consist of blocks 10 as described above.

Figure 5:
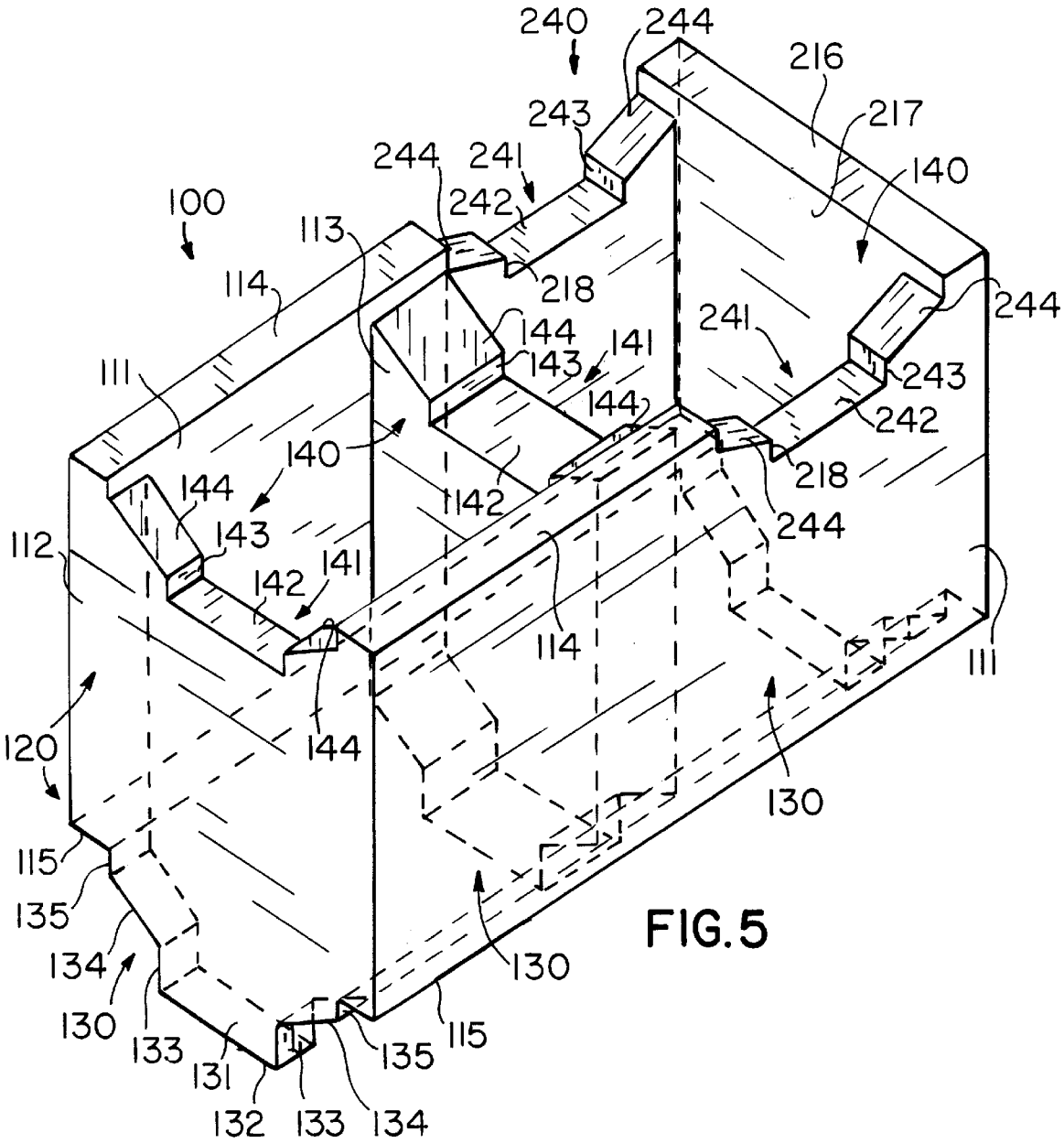
FIG. 5 is a perspective view of a corner block, with the occluded features shown in outline.

In order to provide a simple system for constructing corners using the blocks 10 as described above, corner blocks 100 as shown in FIG. 5 are provided. The corner blocks 100 have some features identical to the blocks 10. At what will be the interior end of the corner block 100, an interior end wall 112 is provided with alignment means 120 comprising a projection member 130 comprising a tongue member 131 with a lower edge 132, side walls 133, sloping walls 134 and joint recess side walls 135, and a recess member 140 comprising a groove member 141 with a lower edge 142, side walls 143 and sloping walls 144. A middle wall 113 has equivalent projection and recess members 130 and 140. Side walls 111 have upper longitudinal edges 114 and lower longitudinal edges 115. For this half of the corner block, the interior half which will abut one of the standard blocks 10 in a particular course, these components are identical to the equivalent components of the block 10 as described in detail previously. The other half of the corner block 100 is configured much differently. The opposite end wall 217, which will be exposed to the exterior side of the corner, has a generally flat and planar upper lateral edge 216 which forms the lower boundary to receive mortar 99, while the lower portion of the exterior end wall 217 has a projection member 130 comprising a tongue member 131 with a lower edge 132, side walls 133, sloping walls 134 and joint recess side walls 135, the projection member 130 being configured the same as the projection members 130 on the middle wall 113 and interior end wall 112.

A pair of opposing lateral recess members 240 are positioned on the upper longitudinal edge 114 between the middle wall 113 and the exterior end wall 217, such that the side walls 111 of the corner block 100 do not present a complete rectangular perimeter. The lateral recess members 240 each comprise a groove member 241 with a lower edge 242, side walls 243 and sloping walls 244. The sloping walls 244 abut the exterior of the interior side of the exterior end wall 217 a distance below the upper lateral edge 216 and abut a pair of joint recess walls 218 extending downward from said upper longitudinal edges. The lateral recess members 240 are structured and dimensioned to match the other recess members 140 and 40, so that they can receive the projection members 130 in the same manner as regular blocks 10.

A corner is constructed by building a course with one corner block 100 positioned with the exterior end wall 217 disposed at the end of the course where the corner is to be formed. A standard block 10 is mounted at a right angle to the corner block 100, abutting it in normal manner. The upper course is laid by positioning a corner block 100, again with the exterior end wall 217 disposed at the end of the upper course, at a right angle to the lower corner block 100. This is accomplished by placing the projection members 130 of the upper corner block 100 into the lateral recess members 240 of the lower corner block 100 and into the recess members 40 of the adjacent block 10 positioned in the same course as the lower corner block 100. The corner can be formed in either direction. The projection member 130 of the exterior end wall 217 of the upper corner block 100 will rest in the exterior lateral recess member 240 of the lower corner block 100. The projection member 130 of the middle wall 113 of upper corner block 100 will rest in both the interior lateral recess member 240 of the lower corner block 100 and in the recess member 40 of the abutting end wall 12 of the lower block 10. The projection member 130 of the interior end wall 112 of the upper corner block 100 will rest in the recess member 40 of the middle wall 13 of the lower block 10. The upper lateral edge 216 of the lower corner block 100 extends beneath a portion of the lower longitudinal edge 115 of the upper corner block 100 to form the recess to receive mortar 99. Each course is then formed by disposing the upper corner block 100 perpendicularly to the lower corner block 100.

It is understood that equivalents and substitutions to certain elements set forth above may be obvious to those skilled in the art, and the true scope and definition of the invention therefore is to be as set forth in the following claims.

I claim:

1. A building block comprising a pair of side walls joined to a pair of end walls, a middle wall bridging said side walls, a pair of longitudinal upper edges on said pair of side walls, a pair of longitudinal lower edges on said pair of side walls, and alignment means for aligning said block with other similar blocks such that said block is properly aligned in the lateral and vertical direction, said alignment means comprising projection members and recess members, where said projection members each comprise a tongue member defined by a pair of joint recess side walls connected to said pair of longitudinal lower edges of said side walls, a pair of sloping walls connected to and angled downward from said pair of joint recess side walls, a pair of tongue side walls connected to said tongue sloping walls, and a tongue lower edge connecting said tongue side walls, where said recess members each comprise a groove member defined by a pair of groove sloping walls connected to and angled downward from said pair of side walls, a pair of groove side walls connected to said groove sloping walls, and a groove lower edge connected to said groove side walls, where said tongue side walls are longer than said groove side walls.

2. The block of claim 1, where, with said pair of side walls vertically oriented, said pair of joint recess side walls, said pair of tongue side walls and said pair of groove side walls are vertically oriented and said tongue lower edge and said groove lower edge are horizontally oriented.

3. The block of claim 1, where said projection members and said recess members are each portions of said pair of end walls and said middle wall and are positioned between said pair of side walls.

4. The block of claim 3, where said projection members are each a lower portion of said pair of end walls and said middle wall, and said recess members are each an upper portion of said pair of end walls and said middle wall.

5. The block of claim 1, where each of said pair of longitudinal lower edges is wider than each of said pair of upper longitudinal edges at the junctures of said end walls and said middle wall with said pair of side walls.

6. The block of claim 1, where each of said pair of side walls is approximately 8 inches by 16 inches and approximately 1 inch in thickness, where each of said end walls is approximately 8 inches wide and approximately 1 inch in thickness, where said projection members extend approximately 2 inches below said pair of lower longitudinal edges, and where said recess members extend approximately 1.5 inches below said upper longitudinal edges.

7. The block of claim 6, where each of said pair of joint recess side walls is approximately 0.5 inches in length, each of said pair of tongue side walls is approximately 1 inch in length, where each of said groove sloping walls is connected to one of said pair of side walls approximately 0.5 inches below said pair of upper longitudinal edges, where each of said pair of groove side walls are approximately 0.5 inches in length, and where said tongue lower edge and said groove lower edge are each approximately 3 inches in length.

8. A wall structure comprising multiple building blocks, where each of said blocks comprises a pair of side walls joined to a pair of end walls, a middle wall bridging said side walls, a pair of longitudinal upper edges on said pair of side walls, a pair of longitudinal lower edges on said pair of side walls, and alignment means for aligning said blocks with each other such that said blocks are properly aligned in the lateral and vertical direction within said wall structure, said alignment means comprising projection members and recess members, where said projection members each comprise a tongue member defined by a pair of joint recess side walls connected to said pair of longitudinal lower edges of said side walls, a pair of sloping walls connected to and angled downward from said pair of joint recess side walls, a pair of tongue side walls connected to said tongue sloping walls, and a tongue lower edge connecting said tongue side walls, where said recess members each comprise a groove member defined by a pair of groove sloping walls connected to and angled downward from said pair of side walls, a pair of groove side walls connected to said groove sloping walls, and a groove lower edge connected to said groove side walls, where said tongue side walls are longer than said groove side walls whereby when one of said blocks is positioned on top of another of said blocks said tongue lower edges abut said groove lower edges and whereby said tongue sloping walls and said groove sloping walls do not abut and thereby define interior wall recesses, and whereby said pair of upper longitudinal edges do not abut and thereby define a pair of longitudinal joint recesses.

9. The wall structure of claim 8, where, with said pair of side walls vertically oriented, said pair of joint recess side walls, said pair of tongue side walls and said pair of groove side walls are vertically oriented and said tongue lower edge and said groove lower edge are horizontally oriented.

10. The wall structure of claim 8, where said projection members and said recess members are each portions of said pair of end walls and said middle wall and are positioned between said pair of side walls.

11. The wall structure of claim 10, where said projection members are each a lower portion of said pair of end walls and said middle wall, and said recess members are each an upper portion of said pair of end walls and said middle wall.

12. The wall structure of claim 8, where each of said pair of longitudinal lower edges is wider than each of said pair of upper longitudinal edges at the junctures of said end walls and said middle wall with said pair of side walls.

13. The wall structure of claim 8, where each of said pair of side walls is approximately 8 inches by 16 inches and approximately 1 inch in thickness, where each of said end walls is approximately 8 inches wide and approximately 1 inch in thickness, where said projection members extend approximately 2 inches below said pair of lower longitudinal edges, and where said recess members extend approximately 1.5 inches below said upper longitudinal edges.

14. The wall structure of claim 13, where each of said pair of joint recess side walls is approximately 0.5 inches in length, each of said pair of tongue side walls is approximately 1 inch in length, where each of said groove sloping walls is connected to one of said pair of side walls approximately 0.5 inches below said pair of upper longitudinal edges, where each of said pair of groove side walls are approximately 0.5 inches in length, and where said tongue lower edge and said groove lower edge are each approximately 3 inches in length.

15. The wall structure of claim 8, further comprising multiple starter blocks, where each of said starter blocks comprises a pair of side walls joined to a pair of end walls, a middle wall bridging said sides walls, a pair of longitudinal upper edges on said pair of side walls, a pair of longitudinal lower edges on said pair of side walls, lower lateral edges on said pair of end walls and said middle wall, and alignment means for aligning said starter blocks with said building blocks such that said building blocks are properly aligned in the lateral and vertical direction within said wall structure, said alignment means comprising recess members, where said recess members each comprise a groove member defined by a pair of groove sloping walls connected to and angled downward from said pair of side walls, a pair of groove side walls connected to said groove sloping walls, and a groove lower edge connected to said groove side walls, where said starter blocks are positioned to define the lowest course of blocks in said wall structure, where said tongue side walls are longer than said groove side walls whereby when one of said building blocks is positioned on top of one of said starter blocks said tongue lower edges abut said groove lower edges and whereby said tongue sloping walls and said groove sloping walls do not abut and thereby define interior wall recesses, and whereby said pair of upper longitudinal edges do not abut and thereby define a pair of longitudinal joint recesses.

16. The wall structure of claim 8, further comprising corner blocks, where each of said corner blocks comprises a pair of side walls joined to a pair of end walls, one said end wall being an exterior end wall and the other being an interior end wall, a middle wall bridging said sides walls, a pair of longitudinal upper edges on said pair of side walls, a pair of longitudinal lower edges on said pair of side walls, an upper lateral edge on said exterior end wall, and alignment means for aligning said corner blocks with each other and with said building blocks such that all said blocks are properly aligned in the lateral and vertical direction within said wall structure to form a right angle corner, said alignment means comprising projection members and recess members, where said projection members are positioned on said interior end wall, said middle wall and said exterior end wall and each comprise a tongue member defined by a pair of joint recess side walls connected to said pair of longitudinal lower edges of said side walls, a pair of sloping walls connected to and angled downward from said pair of joint recess side walls, a pair of tongue side walls connected to said tongue sloping walls, and a tongue lower edge connecting said tongue side walls, where two of said recess members each comprise a groove member defined by a pair of groove sloping walls connected to and angled downward from said pair of side walls, a pair of groove side walls connected to said groove sloping walls, and a groove lower edge connected to said groove side walls, where one said recess member is positioned on said interior end wall and the other is positioned on said middle wall, where another two of said recess members are lateral recess members positioned on said pair of upper longitudinal edges between said middle wall and said exterior end wall, and where each of said lateral recess members each comprises a groove member defined by a pair of groove sloping walls connected to and angled downward from said exterior end wall and from a pair of depending joint recess walls connected to said pair of upper longitudinal edges, a pair of groove side walls connected to said groove sloping walls, and a groove lower edge connected to said groove side walls, where said tongue side walls are longer than said groove side walls whereby when one of said corner blocks is positioned at a right angle on top of another of said corner blocks said tongue lower edges at said exterior end wall and said middle wall abut said groove lower edges in said lateral recess members and whereby said tongue sloping walls and said groove sloping walls do not abut and thereby define interior wall recesses, and whereby one of said pair of lower longitudinal edges does not abut with said upper lateral edge and thereby partially define a pair of longitudinal joint recesses, and where said tongue lower edges at said interior wall and said middle block abut said groove lower edges in one of said end walls and said middle wall of one of said building blocks and whereby said tongue sloping walls and said groove sloping walls do not abut and thereby define interior wall recesses.

* * * * *